US005647308A

United States Patent [19]

Biagini

[11] Patent Number: 5,647,308

[45] Date of Patent: Jul. 15, 1997

[54] CRANK MECHANISM SYSTEM FOR THE TRANSFORMATION OF RECIPROCATING LINEAR MOTION INTO ROTARY MOTION, PARTICULARLY SUITABLE FOR RECIPROCATING ENDOTHERMIC ENGINES

[75] Inventor: Livio Biagini, Bologna, Italy

[73] Assignee: Pomezia S.R.L., Bologna, Italy

[21] Appl. No.: 528,646

[22] Filed: Sep. 7, 1995

[30] Foreign Application Priority Data

Sep. 13, 1994 [IT] Italy ..... RM94A0580

[51] Int. Cl.[6] ..... F02B 75/22

[52] U.S. Cl. ..... 123/56.2; 123/197.1

[58] Field of Search ..... 123/197.1, 197.3, 123/56.2, 56.4, 55.3

[56] References Cited

U.S. PATENT DOCUMENTS

| | | | |
|---|---|---|---|
| 629,039 | 7/1899 | Luitwieler et al. | 123/55.3 |
| 1,784,902 | 12/1930 | Maurais | 74/55 |
| 1,806,608 | 5/1931 | Bryant | 123/55.3 |
| 1,873,015 | 8/1932 | Omo | 123/197.1 |
| 2,006,498 | 7/1935 | Dasset | 123/197.1 |
| 2,120,657 | 6/1938 | Tucker | 123/54.3 |
| 2,249,951 | 10/1941 | Fulton | 74/55 |
| 2,417,649 | 3/1947 | Johansen et al. | 123/197.1 |
| 3,572,209 | 3/1971 | Aldridge et al. | 123/54.3 |
| 3,604,402 | 9/1971 | Haltz | 123/55.3 |
| 3,998,200 | 12/1976 | Sudholt | 123/197.1 |
| 4,149,498 | 4/1979 | Ferrell | 123/56.7 |
| 4,301,776 | 11/1981 | Fleming | 123/197.1 |
| 4,430,967 | 2/1984 | Williams | 123/197.1 |
| 4,489,681 | 12/1984 | Jackson | 123/52.3 |
| 4,493,296 | 1/1985 | Williams | 123/55.3 |
| 4,966,067 | 10/1990 | Ames et al. | 92/150 |

FOREIGN PATENT DOCUMENTS

| | | | |
|---|---|---|---|
| 2655378 | 6/1991 | France . | |
| 2908196 | 9/1980 | Germany | 132/197.1 |
| 2278773 | 12/1994 | United Kingdom | 123/197.1 |

*Primary Examiner*—David A. Okonsky

*Attorney, Agent, or Firm*—Beveridge, DeGrandi, Weilacher & Young, LLP

[57] ABSTRACT

The present invention relates to a crank system for the transformation of reciprocating linear motion into rotary motion, particularly suitable for reciprocating endothermic engines, comprising a wheel or rotating connection rod (2), idly provided on the engine piston (5) pin (3), and a cam (1), provided on the output shaft (6), having a perimetric profile made up of at least two segments or cam arches for the optimisation of the engine cycle strokes, said wheel (2) rotating along the profile of said cam (1) with a coupling characterized by the absence of friction or by a minimum friction.

20 Claims, 7 Drawing Sheets

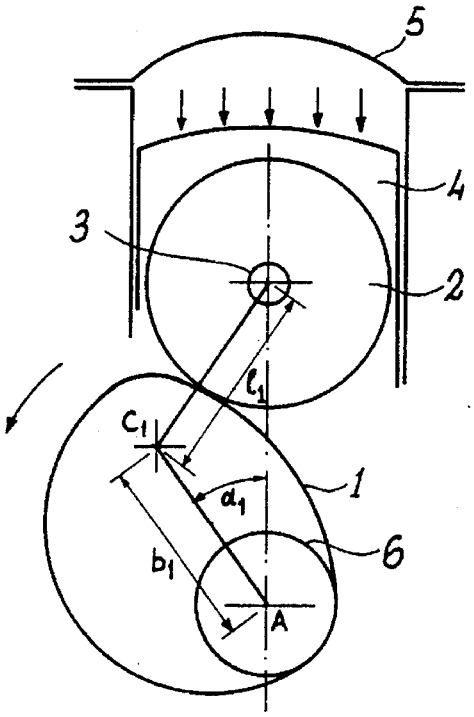
FIG. 4a
FIG. 4b
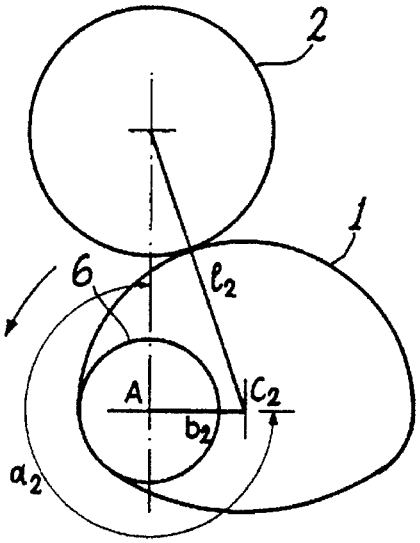
FIG. 4c
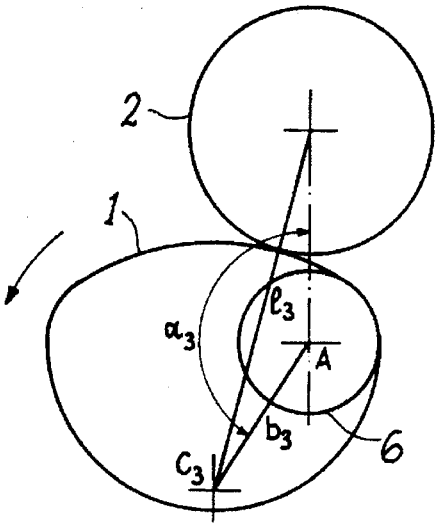
FIG. 4d
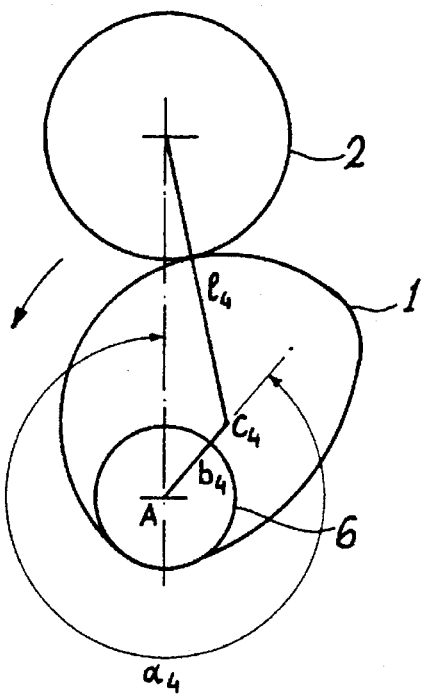

CRANK MECHANISM SYSTEM FOR THE TRANSFORMATION OF RECIPROCATING LINEAR MOTION INTO ROTARY MOTION, PARTICULARLY SUITABLE FOR RECIPROCATING ENDOTHERMIC ENGINES

The present invention relates to a crank mechanism system for the transformation of reciprocating motion into rotary motion, particularly suitable for reciprocating endothermic engines.

More specifically, the invention refers to a system of the above kind that allows to improve the operation of a thermodynamic cycle and the exploitation of the forces obtained by the same thermodynamic cycle.

It is well known that in an endothermic reciprocating engine, the reciprocating motion of the piston is transformed into rotary motion, usually by the connecting rod—crank system, the latter being fixedly coupled to the output shaft.

In the enclosed FIG. 1, the parts comprising an engine according to the prior art are indicated employing the following symbology.

I=connecting rod length r=crank radius, so that the piston stroke C will be equal to 2r β=angle between the connecting rod axis and the cylinder axis α=angular displacement of the crank with respect to the Top Dead Centre (T.D.C.).

Furthermore, it is known that the direction of the motion of the piston reverses twice for each complete revolution of the crank in correspondence of the Top Dead Centre (TDC) and of the Bottom Dead Centre (BDC).

From FIG. 1, it can be further seen that the torque acting on the output shaft is a function both of the force acting along the connecting rod axis and of the crank radius.

Force Fb is obtained by the vectorial composition of force Fn, produced by the thermodynamic cycle, and of the force F, due to the reaction of the wall of the cylinder to the piston thrust, said thrust being due to the inclination β of the connecting rod axis. Said thrust determines a friction loss.

The torque is equal to:

$$Mm = F \times \frac{r \times [\sin\alpha + \lambda/2 \times \sin\alpha]}{\sqrt{1-\lambda^2 \sin^2\alpha}}$$

$$\frac{2}{\sqrt{1-\lambda^2 \sin^2\alpha^\circ}}$$

Neglecting the term $\lambda^2 \sin^2 \alpha°$, we obtain:

$Mm=F\times r\times[\sin \alpha+\lambda/2\times\sin \alpha]$ i.e.: Mm=F×"f", wherein "f"=$r\times[\sin \alpha+\lambda/2\times\sin \alpha]$.

In the above formula, Mm is the torque, F is the force acting on the piston head produced by the thermodynamic cycle, r is the crank radius, α is the crank angle with respect to the cylinder axis and λ is the r/l ratio.

Force F acting on the piston head is obtained by the thermodynamic cycle, which is approximately represented for a four-stroke endothermic engine with an Otto cycle (having the ignition of the air—combustible by a controlled spark) in figure by a Cartesian diagram wherein the abscissa indicates the displacement of the piston and the ordinate the pressure within the cylinder above the piston head.

As it is possible to note from FIG. 2, the real cycle, shown by a full line, covers a lower area than the theoretical cycle (shown by a hatched line) for several reasons, among which one of the most important is the one deriving from the fact that the combustion controlled by the spark does not instantaneously occur at the TDC, but during a certain period of time, so that the piston during its reciprocating motion makes a part of the stroke toward the TDC and a part of positive stroke after the TDC, before that completely occurs the fuel combustion.

As it is clearly recognised in the literature, this fact involves a reduction of the net work obtained, said reduction being indicated by some authors as the 10–15% of the obtainable net work.

It is still known that the working cycle of the engine, let say a four-stroke engine, is performed, taking into consideration only its geometrical aspects, in four strokes, each one corresponding to half revolution, i.e. an angle of 180° run by the crank. By this misalignment the cylinder axis with respect to the rotation centre of the output shaft, stroke having different duration can be obtained (usually short misalignment are obtained and therefore short differences, so that this case can be neglected).

The above considerations have been made with particular reference to a reciprocating four—stroke endothermic engine with controlled spark ignition, but the same considerations are valid, with the appropriated differences, for a two-stroke engine and for a diesel engine.

Recently, rotary engines have been realized, said engines not requiring a system for the transformation of the reciprocating motion into rotary motion, and being very interesting under a technical point of view.

For example, it can be made reference to the turbine engine and to the WANKEL engine, most suitable for the single uses.

Notwithstanding the good technical properties of the solution, the engine manufacturers have not been too much interested basically due to the fact that the advantages of these engines (particularly for the medium/little cases) are too much little to take the decision of abandoning a production line with the relevant tools, and the connected search investments, for a new product giving limited advantages.

It is obvious that a new solution in the engine field to be successful must give remarkable advantages as far economy, production easy, use of the already available plants and production costs are concerned.

In view of the above, the Applicant has realized a crank mechanism that allows to obtain remarkable advantages with respect to the presently available solutions, further realizing a solution advantageously adaptable by the manufacturers.

In fact, the solution according to the invention allows to realize a working cycle with a constant volume combustion.

Further, the solution proposed allows to realize cycles with a variable amplitude, without employing the misalignment, within important limits.

By the solution according to the invention, it can be also realized a remarkable increase of the value of the torque formula up to a ponderal average doubling of the relevant integral. This proportionally means a reduction of the same consumption percentage, with the relevant increase of the specific power for piston displacement unit.

Adopting the solution proposed according to the present invention, it can be manufactured an engine having reduced dimensions, and thus lighter and cheaper.

Moreover, the invention allows to produce employing the production lines, machines and technologies already existing.

Another advantage obtained by the system according to the invention is the one relevant to the solution of the stratified charge problem, in order to reach the zero value pollution provided by the laws for the end of the nineties.

These and other results are obtained according to the present invention by a crank mechanism replacing the traditional connecting rod-crank assembly by the combination of a wheel, or rotary connecting rod, idly mounted on the piston pin, and of a cam mounted on the output shaft.

It is therefore a specific object of the present invention a crank system for the transformation of reciprocating linear motion into rotary motion, particularly suitable for reciprocating endothermic engines, comprising a wheel or rotating connection rod, idly provided on the engine piston pin, and a cam, provided on the output shaft, having a perimetral profile made up of at least two segments or cam arches for the optimisation of the engine cycle strokes, said wheel rotating along the profile of said cam with a coupling characterized by the absence of friction or by a minimum friction.

Particularly, according to the invention, said cam could have a first profile segment having one or more curvatures so as to optimise the induction stroke and the expansion stroke, and a second profile segment having one or more curvatures so as to optimize the compression and exhaust strokes.

In the preferred embodiment of the system according to the invention, said cam can provide further segments or arches to optimize the combustion, particularly to obtain a constant volume combustion, in correspondence of the TDC, and the optimisation of the expansion stroke, in correspondence of the BDC.

Particularly, said further segments or arches will have a constant curvature ray corresponding to the distance between the engine axis and the curvature determining the Bottom Dead Centre, and respectively the Top Dead Centre. It must in fact taken into consideration that if the wheel connected to the piston rolls along a profile concentric with respect to rotation axis of the output shaft, the piston remains stopped in its rectilinear motion along the cylinder while the output shaft continues its rotation.

In case it occurs at the Top Dead Centre, along an arch corresponding to the time necessary, from the moment of the ignition, for the complete combustion of the charge contained within the cylinder head, a constant volume combustion stroke will be obtained. This ideal combustion cycle involves according to all the authors and researchers, a remarkable improvement of the thermodynamic efficiency.

In the same way, advantages are obtained in case, with the same method described above, the piston is stopped at the BDC, making it occurring first the complete expansion of the combustion products using all the expansion stroke before opening the exhaust valve. In fact, as graphically demonstrated, the complete stroke can occur along an angle after the TDC chosen in the most convenient way by the designer, suitably shaping the cam profile.

It is known that the engines manufactured according to the prior art, the stroke always occurs (apart from the eventual misalignment discussed above) along 180° from the TDC to the BDC: in view of the needing of having a suitable amplitude for the exhaust stroke, in this kind of engines the exhaust valve is opened well before the BDC (even 70°–80° before), determining an incomplete expansion, and thus a lower expansion efficiency. The solution according to the invention allows a complete expansion.

The four-stroke engine realized with the present technique works as follows:

I) Induction

II) Compression and, about 35° before of the TDC, the ignition occurs and the combustion starts, while the piston goes up toward the TDC III) Expansion of the TDC toward the BDC. The combustion is not completed before than the TDC, thus continues during the expansion stroke of the piston. The expansion is abruptly interrupted before of the BDC (usually 70° before than the BDC) by the opening of the exhaust valve IV) Exhaust occurring under the thrust of the piston going up from the BDC toward the TDC.

The four strokes lasts 720° of rotation of the output shaft, i.e. 2 complete revolutions.

The four-stroke engine realized according to the invention operates in 2 complete revolutions, i.e. 720° but, in the preferred embodiment, in 5 or 6 strokes:

I) Induction

II) Compression

III) (with the piston stopped) Ignition and complete combustion

IV) Complete expansion

V) (with the piston stopped) Opening of the exhaust valve

VI) Exhaust.

In the described four-stroke engine, strokes V and VI could be also unified. In the two-stroke engine realized according to the invention, it is instead useful to have during the exhaust stroke (or transfer) the piston stopped at the BDC, since this contrivance increases the value of the "time-cross section", improving the engine operation.

Still according to the invention, said wheel and said cam are realized with such a material to make that the compression stress exerted by the wheel remains within the elasticity limits of the materials.

Always according to the invention, means for maintaining the contact between the wheel and the cam will be provided.

According to a first embodiment, said means for maintaining the contact are comprised of a little connecting rod, freely swinging on the same axis of the wheel and provided at the bottom with a projection coupling with a profile concentric with respect to the outer profile of the cam, and accurately reproducing the same.

In another embodiment, said means can be comprised of a rod, constrained at one end, with one or more degrees of freedom, to the piston and to the other end constrained to an elastic system absorbing the inertial energy during the stroke from the Bottom Dead Centre to the Top Dead Centre, giving back the same energy during the first part of the stroke from the Top Dead Centre to the Bottom Dead Centre.

Said elastic system can be replaced, according to the invention, with an hydraulic system, eventually controlled by microprocessors.

The crank system according to the invention can be used in multi-cylinder engines, providing only one cam for all the cylinders, or one cam for each cylinder.

The present invention will be now described for illustrative, but not limitative purposes, according to its preferred embodiments, with particular reference to the figures of the enclosed drawings, wherein.

Figure 6:
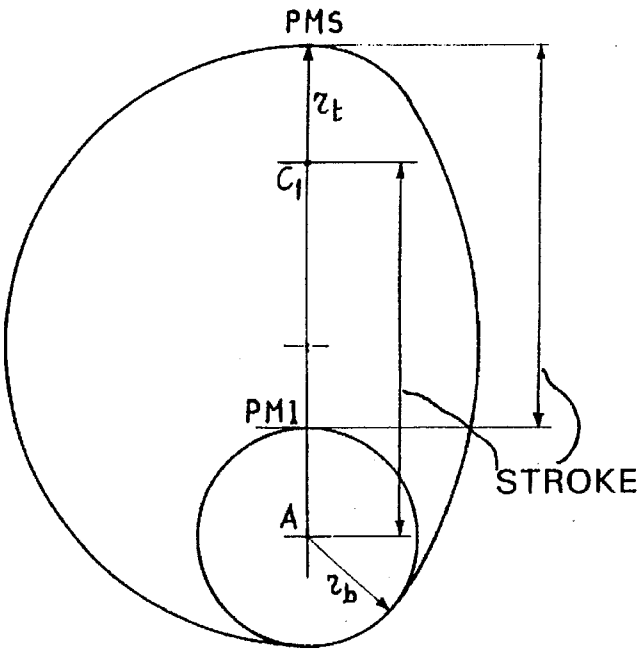
Figure 5:
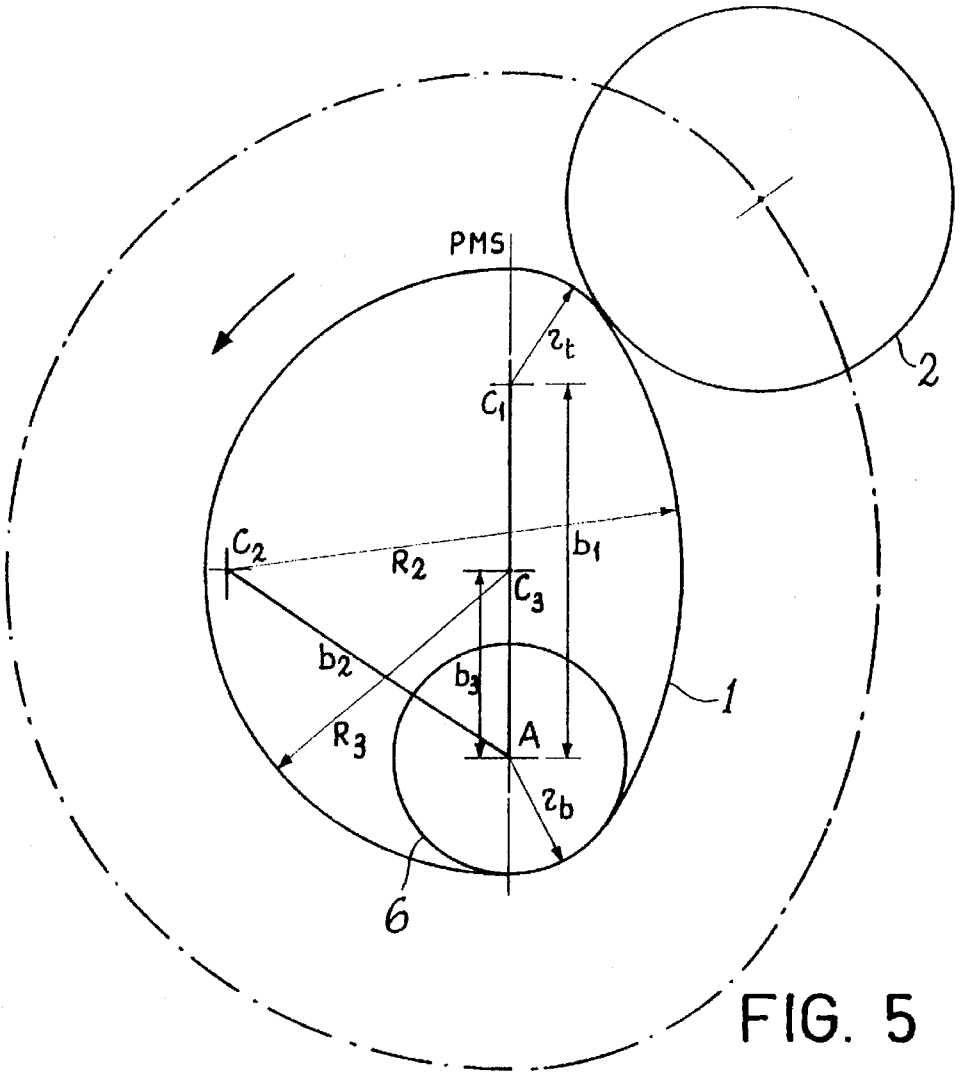
Figure 7:
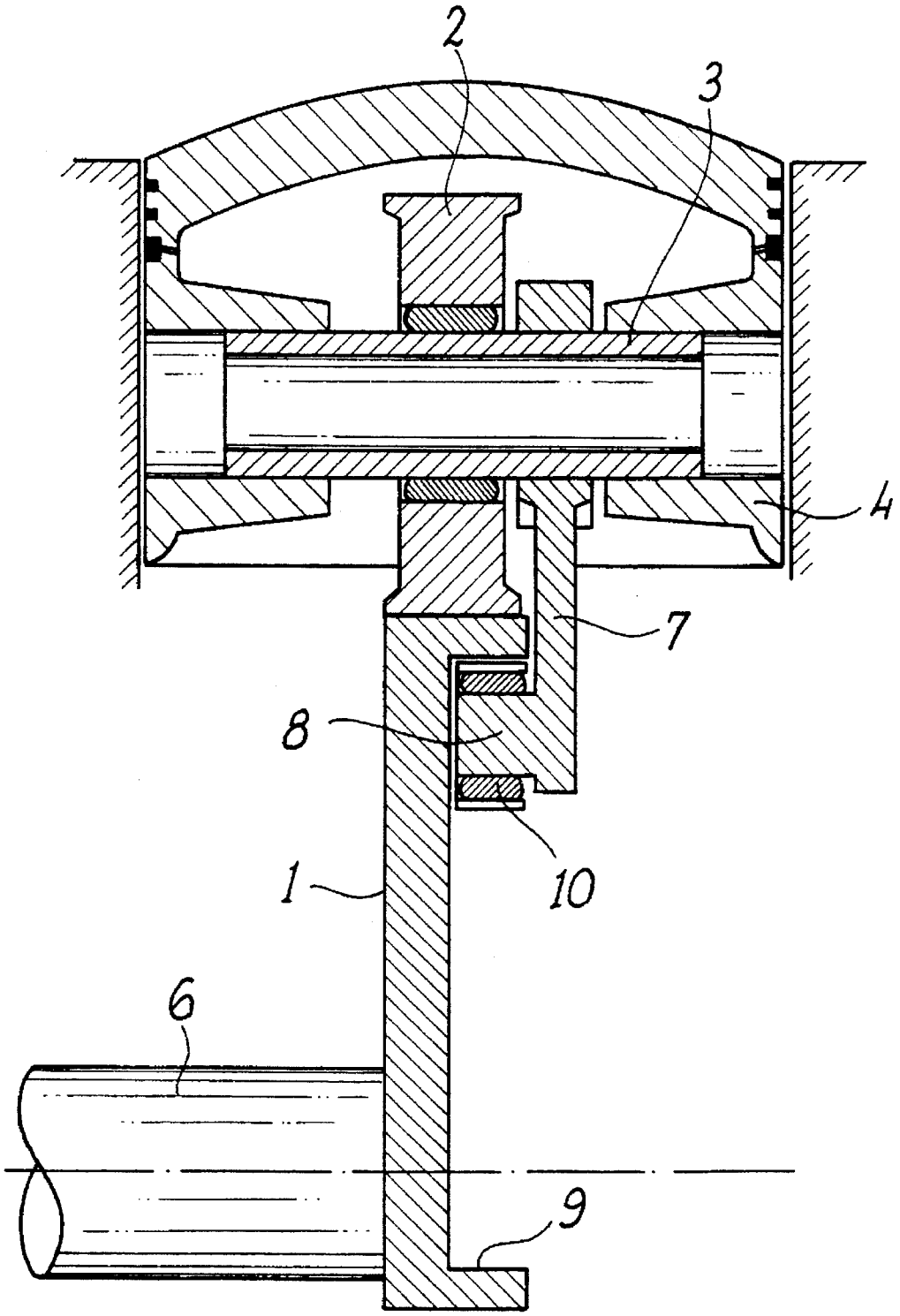
Figure 8:
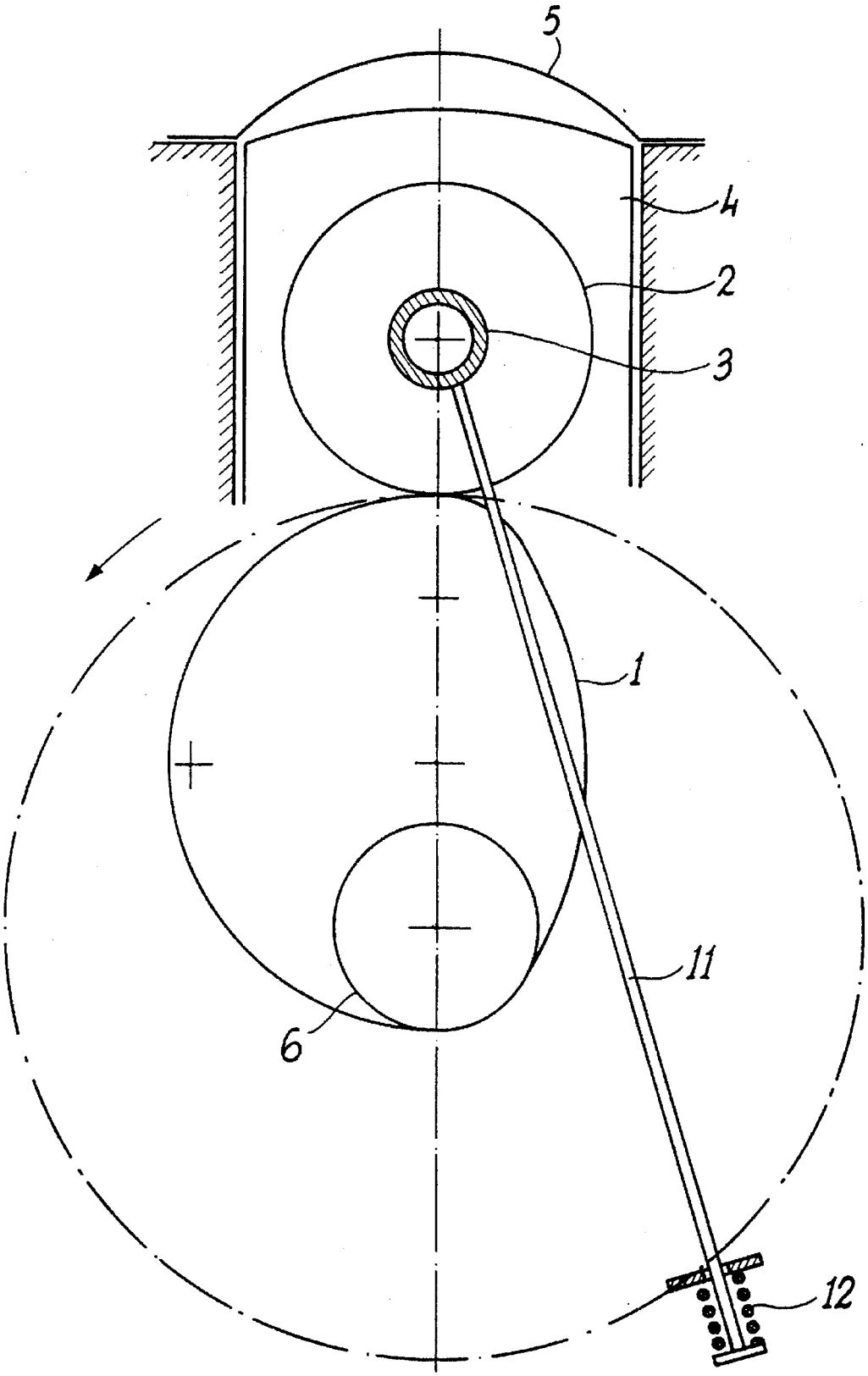
Figure 9:
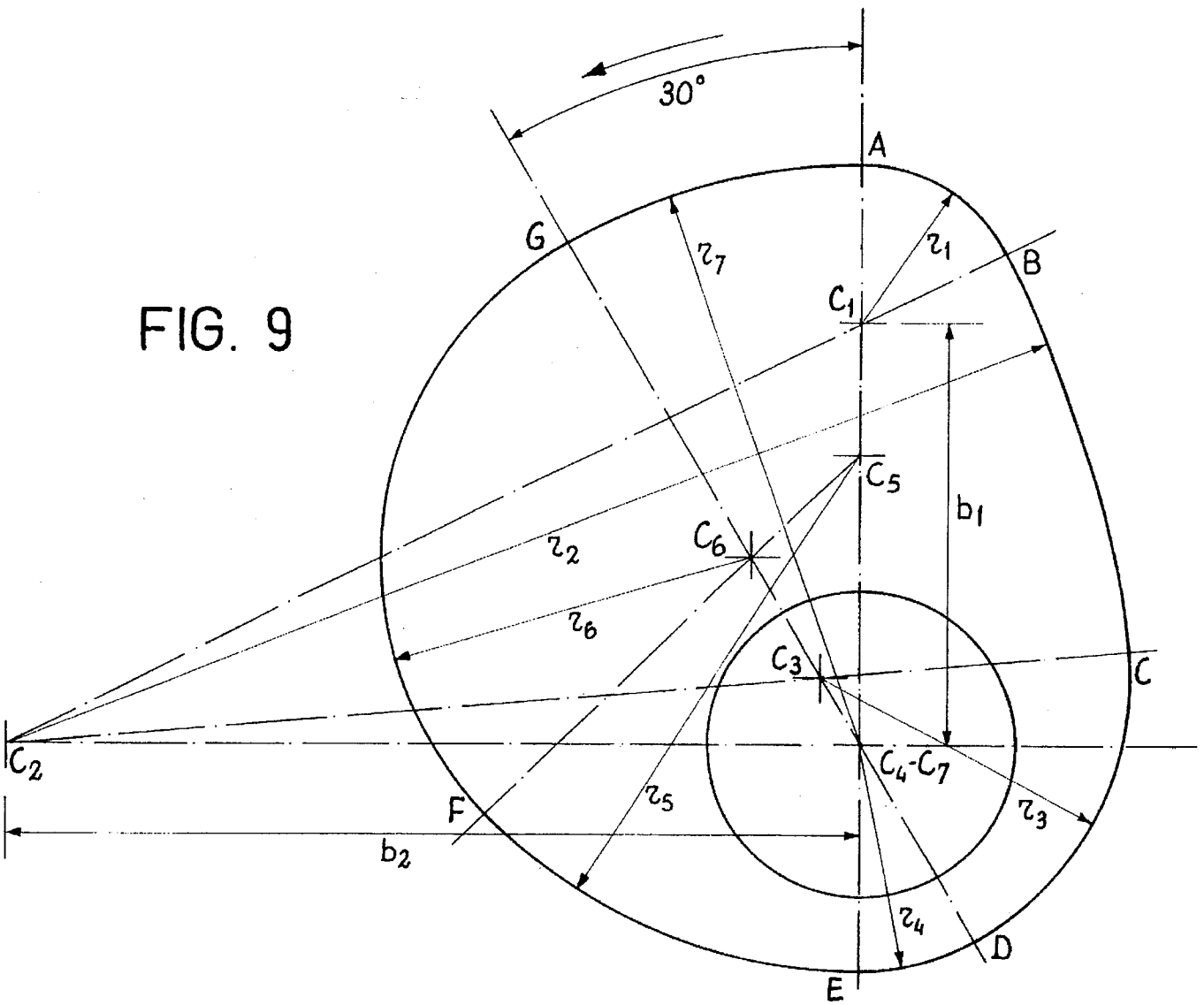

FIGS. 4*a*, 4*b*, 4*c* and 4*d* show the different strokes of the cycle of a four-stroke engine having the crank system according to the invention;

FIG. 5 shows a particularly preferred profile according to the invention;

FIG. 6 shows a scheme of the cam of FIG. 5;

FIG. 7 is a section view of a crank system according to the invention providing means for maintaining constantly the contact between wheel and cam;

FIG. 8 is a schematic view of a second embodiment of the means for maintaining the contact between wheel and cam; and FIG. 9 shows an example of profile of cam to obtain a constant volume combustion.

Before describing in detail the solution according to the invention, it is wished to be pointed out that it will be made a comparison with the prior art solution already discussed in the introduction of the specification, making the preliminary statement that the present qualitative evaluation is based on the comparison of two engines, one realized according to the invention and the other one according to the prior art, having the same piston displacement, bore and stroke, the same cycle (two- or four-stroke), employing the same fuel, the same compression ratio, the same combustion chamber, the same number and sizes of induction and exhaust valves, the same induction and exhaust system, wherein the manufacture is realized employing the same tools and material, and with the same ignition system (spark or compression).

Figure 2:
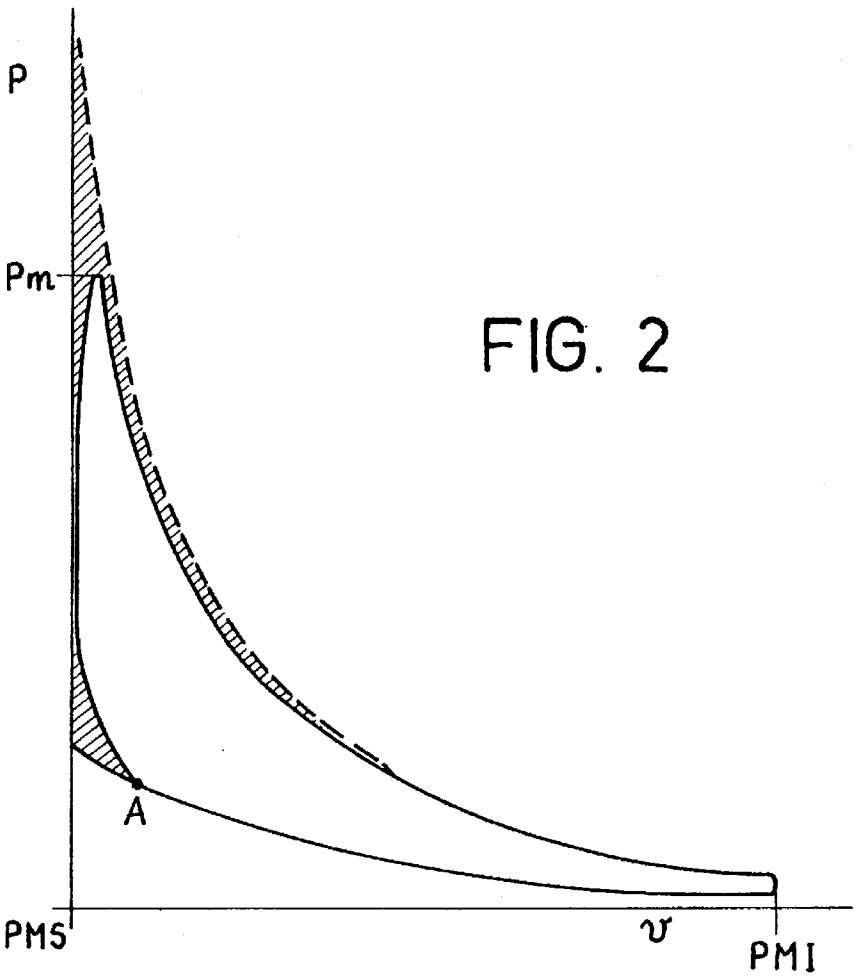
FIG. 2 shows the diagram of an Otto cycle.
Figure 1:
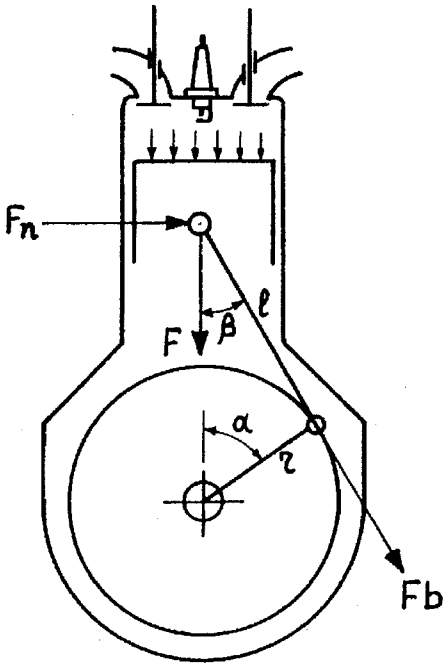
FIG. 1 PRIOR ART
FIG. 1 is a schematic view of an engine according to the prior art.
Figure 3:
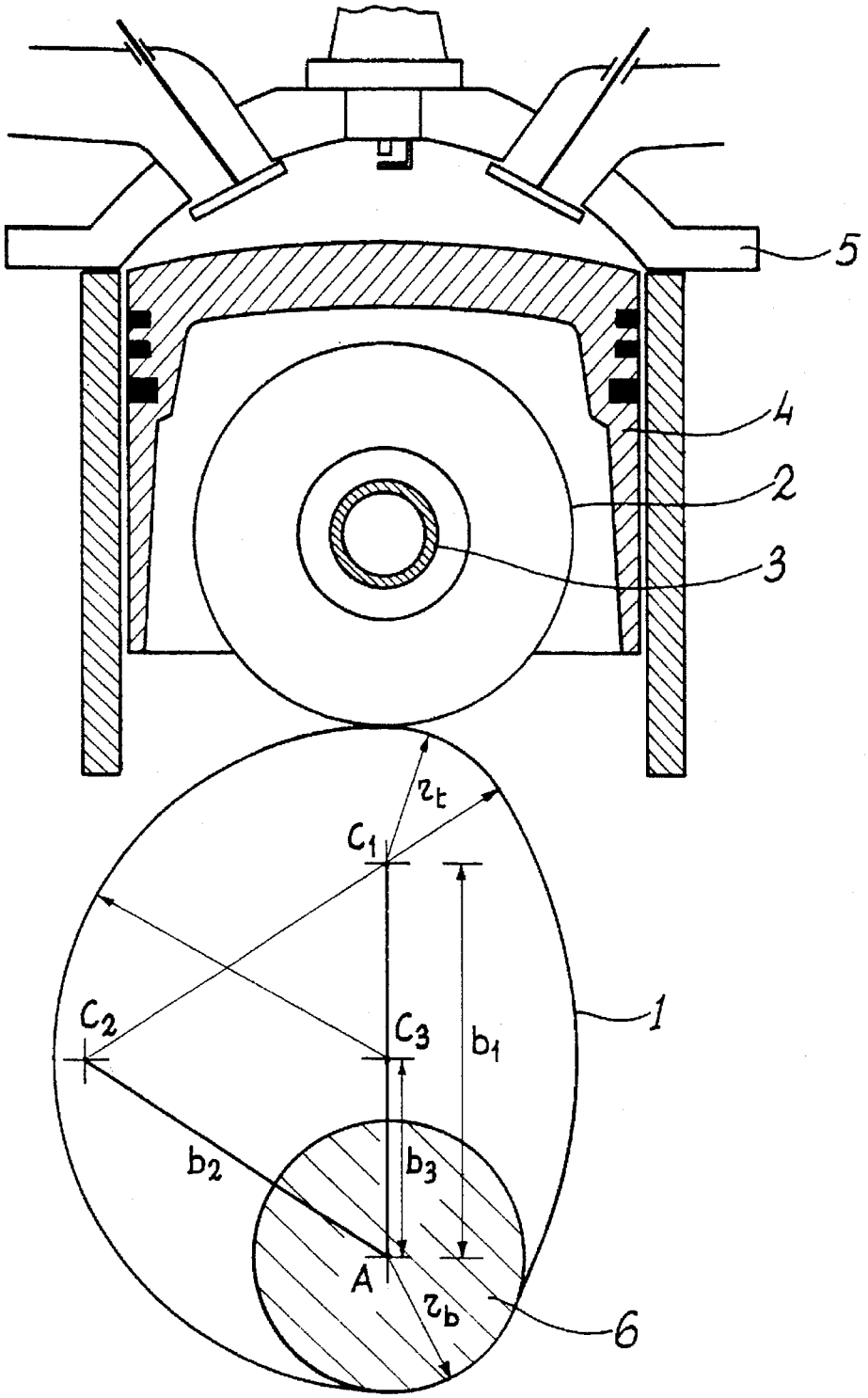
FIG. 3 is a schematic view of an embodiment of the system according to the invention.

Making reference to FIG. 3, the system according to the invention comprises an assembly of parts replacing the system known as connecting rod-crank assembly and shown in FIG. 1.

Particularly, it comprises a cam 1, integral with the output shaft, a wheel 2, freely rotating, thus idle, on the piston pin 3, and one element limiting the freedom of the piston 4 to move along the axis of the cylinder 5, and that will be more specifically described in the following.

The numeric reference 6 indicates the output shaft.

There are also indicated the curvature centres of the cam $C_1$, $C_2$, $C_3$, and the relevant arms $b_1$, $b_2$, $b_3$, the value of which will be indicated in the following within the calculation formula for the torque.

The operation of the engine will be described with reference to a four-stroke engine with a controlled spark, being it necessary to note that in the same way, even if with the proper differences, behaves the innovation applied to a two-stroke engine. In both cases (two-stroke and four-stroke engine) with compression ignition and with any kind of fuel.

Further, in the figure only three curvature centres are shown just to avoid to complicate the drawing.

In FIG. 4 it is indicated the operation of the system according to the invention during the expansion stroke for the combustion product, after the TDC.

On the crown of the piston 4 the pressure of the burnt gases acts, said pressure being indicated by letter p. This determines a force transmitted to the pin 3 of the piston, on the wheel 2, the periphery of which urges on the cam 1.

The motion of the wheel 2 along the cam 1, the profile of which will be suitably studied to optimize the stroke, is of the pure rolling kind, i.e. without sliding, and therefore without friction, being it necessary to take care that the compression stress exerted by the wheel 2 is well within the elasticity limits of the material chosen for the wheel 2 and for the cam 1.

From FIG. 5, representing schematically one of the infinite possible profiles for the cam 1, it can be seen that the rotation of the wheel 2 occurs due to the contact on the cam I profile according to the curvature centre of the profile that in that specific moment was in contact with the wheel 2.

In FIG. 5 the centres of the profile taken into consideration have been indicated by $C_1$, $C_2$, $C_3$, and the distances between said curvature centres and the engine axis have indicated by $b_1$, $b_2$, $b_3$, the engine axis being indicated by the letter A. Distances $b_1$, $b_2$, $b_3$, are the parameters to be introduced in the above mentioned formula giving the value of instantaneous torque in correspondence of the angle $\alpha$ of rotation of the output shaft from the TDC, to replace the value r, i.e. the crank radius.

Coming now to examine FIG. 6, it can be seen that the useful stroke of the piston 4 along the cylinder 5 axis is obtained from the relationship: $C+r_t-r_b$, wherein $C=C_1$ is the distance between the engine axis A and the curvature centre of the cam 1 head, $r_t$ is the curvature radius of the profile of the cam I head (determining the TDC), and $r_b$ is the curvature centre of the cam I base (determining the BDC).

It is easy to note that the engine displacement is obtained multiplying the piston area with the stroke. The stroke of the piston, that for the previously described connecting rod-crank system is equal to 2r, is the constant parameter appearing in the formula for the torque.

Distances $b_1$, $b_2$, $b_3$, etc. can be suitably chosen and can be a multiple of r, although the engine displacement remains equal to a: piston area×2r.

Assuming for example r=26 mm, thus 2r=stroke=52 mm, and choosing:

$r_t=r_b$ 0 16 mm, we shall obtain:

stroke=52 mm=$C+r_t-r_b=C+16-16=52$, and therefore $C=b_1$.

If for example:

$r_t=16$, $r_b=26$, then we shall obtain $b_1=62$, wherein $b_1$ is greater than the stroke.

Taking again the torque formula, we can observe that $$Mm = F \times r \times \frac{[\sin\alpha + \lambda/2 \times \sin\alpha]}{\sqrt{1-\lambda^2 \sin^2 \alpha^\circ}}$$

Neglecting the term $\lambda^2 \sin^2 \alpha$, and thus assuming the term $\sqrt{1-\lambda^2 \sin^2 \alpha}$ equal to 1, with a force acting on the piston F equal either in the already examined connecting rod-crank system or in the system according to the invention, the instantaneous $M_m$ is a function of "f"=r×[sin $\alpha$+$\lambda$/2×sin $\alpha$], wherein r=stroke=constant value, and I=constant connecting rod length, for the engine taken into consideration.

$\lambda$=r/l (according to the prior art $\lambda$ is equal to about 0.25).

In the system according to the invention, r=$b_1$, $b_2$, $b_3$, etc., the value of which is obtained adding the wheel 2 ray (that in this example is constant since the wheel 2 has been assumed as a circle) and the curvature ray of the several profile length of the cam 1.

Developing the search of the value of the above mentioned function "f" for an engine according to the prior art and for an engine with system according to the invention, with the same stroke=52 mm, with a connecting rod having a length l=110 mm for the prior art engine, and employing the cam 1 shown in FIG. 6, with the wheel 2 having a diameter of 76 mm, the values of the function "f" for the two cases are, with a good approximation, those indicated in the following table I, with equal piston strokes:

TABLE 1

| PISTON Stroke mm | PRIOR ART "f" | INNOVATIVE SYSTEM "f" |
|---|---|---|
| 2,5 | 7,7 | 20,8 |
| 9 | 21,5 | 40 |
| 17,5 | 24 | 44 |
| 29,5 | 26 | 37 |
| 37 | 21,8 | 31 |
| 41 | 20,4 | 22 |
| 49 | 7,8 | 16 |

Even taking into consideration that for the system according to the invention, due to the greater inclination of the thrust directrix exerted by the wheel 2 on the cam 1 profile, with respect to the cylinder axis, a higher loss in the relative motion between the piston skirt and the cylinder is present, the advantage obtained is practically remarkable since in the prior art engine the expansion is interrupted while the solution according to the invention allows to complete the expansion.

In conclusion, the expansion stroke, and the active cycle, ends with a remarkable increase of the power obtained with respect to the values obtained with the solution according to the prior art, and this is due either for the increased thermodynamic efficiency following to the constant volume combustion, or for the complete expansion, or for the reduction of the friction losses with respect to the connecting rod-crank system.

The solution according to the invention can be advantageously used for multi-cylinder engines, providing a sole cam 1 for all the cylinders, or a number of cams 1 corresponding to the number of cylinders.

In FIG. 4*b* the exhaust stroke is shown. The piston 4 is thrust by the profile, by means of the wheel 2, to go up from the BDC toward the TDC, using the energy stored in the fly-wheel.

When the output shaft 6 has made a determined circle arch from the BDC, the wheel 2 has the tendency of loosing the contact with the cam.

Therefore, it must be provided a device that bucks the energy conferred by the cam 1 to the piston 4, and maintains the contact with the wheel 2.

An embodiment of this kind of device is shown in FIG. 7, being it understood that it is simply illustrative, since it is possible to adopt many other equivalent solutions.

The device of FIG. 7 comprises a little connecting rod 7, provided coaxially behind the wheel 2 and having at the bottom a projection 8 coupling with the rear profile 9 of the cam 1, said rear profile 9 exactly reproducing the outer profile of the cam 1.

Above said projection, a wheel or slide 10 is provided, in order to make the sliding of the little connecting rod 7 along the profile 9 completely not influential for the motion of the cam 1.

As already said, the little connecting rod has only the aim of maintaining constant the distance between the centre of the wheel 2 and the outer profile of the cam 1.

Another embodiment of the means for maintaining constant said distance is shown in FIG. 8.

In this case, the device comprises a rod 11, constrained, with one or more degrees of freedom, to the piston 4, for example at the lower part of the same piston 4 (in the figure the rod 11 is constrained to the pin 3 of the piston 4). The other end of the rod 11 is constrained to an elastic element 12, suitable to absorb the inertial energy of the piston 4 during its stroke from the BDC to the TDC, giving it back during the first part of the stroke from the TDC to the BDC.

As already said, the elastic element can be replaced with an hydraulic system, eventually controlled by microprocessor.

In FIG. 4*c*, the induction stroke is shown. In this case, the piston 4 must be forced to follow the cam I profile, and therefore it is necessary the device the obliges the piston 4 to leave the position corresponding the BDC. After a determined circle arch made by the output shaft 6, the action of the device is no more necessary since the inertial energy of the piston 4 allows the restoration of the contact between the wheel 2 and the cam 1, the latter opposing the inertia of the piston, annulling the same in correspondence of the BDC.

In FIG. 4*d*, the compression stroke is shown. As in exhaust stroke, the separation of the wheel 2 from the cam 1 would occur (although the negative work of the piston 4 during the compression stroke can assume such values to annul in some cases the inertia), and thus in this case too it is necessary the action of the abovementioned device.

In FIG. 9, it is shown an example of multicenter cam profile allowing to maintain a constant volume during the combustion.

The example shown has been realized for a piston stroke= 56 mm.

In the figure, $C_1$, $C_2$, $C_3$, $C_4$, $C_5$, $C_6$, $C_7$ define the multicenter profile, $r_1, \ldots, r_7$ the curvature rays and A, B, C, D, E, F, G, the tangency points.

The rotation of the cam 1 occurs in the counterclockwise direction, and the piston stroke is calculated as $C_4+C_5+r_1-r_4=56$ mm.

The diameter of the rotating connecting rod 2 is equal to 70 mm.

The arch A-B-C-D is the arch for expansion and induction strokes, along the arch D-E the piston is stopped in correspondence of the BDC, the arch E-F-G is the arch for the exhaust and compression strokes, while along the arch G-A the piston is stopped in correspondence of the TDC.

Just in correspondence of the last arch, that in this example is an arch of 30°, the constant volume combustion occurs.

The stop time has been calculated t=0.001 sec, with a peripheral speed of the cam of 4500 rpm.

The present invention has been described for illustrative, but not limitative purposes, according to its preferred embodiments, but it is to be understood that modifications and/or changes can be introduced by those skilled in the art without departing from the relevant scope, as defined by the enclosed claims.

I claim:

1. A crank system for the transformation of reciprocating linear motion into rotary motion, particularly suitable for reciprocating endothermic engines, characterized in that it comprises a wheel, a cam, and an output shaft, said wheel idly provided on an engine piston pin, said wheel being in direct contact with said cam, said cam having a select profile and being mounted on said shaft where the wheel rolls along a profile concentric with respect to rotation axis of the output shaft, said cam having a perimetric profile made up of at least two segments for the optimization of the engine cycle strokes, said cam providing means for maintaining constant volume combustion where said segments are cam arches and said cam provides further arches to optimize constant volume combustion in correspondence with the Top Dead Center (TDC), and the optimization of the expansion stroke, in correspondence with the Bottom Dead Center (BDC), said wheel rotating along the profile of said cam with a minimum friction.

2. A crank system for the transformation of reciprocating linear motion into rotary motion, particularly suitable for reciprocating endothermic engines, characterized in that it comprises a wheel, a cam, and an output shaft, said wheel idly provided on an engine piston pin, said wheel being in direct contact with said shaft, said cam having a select profile and being mounted on said shaft where the wheel rolls along a profile concentric with respect to rotation axis of the output shaft, means for maintaining the contact between the wheel and the cam, where said means for maintaining the contact comprises a little connecting rod for maintaining a constant distance between the center of the wheel and the outer profile of the cam, said rod freely swinging on the same axis of the wheel said rod having a bottom with a projection coupling with a profile concentric with respect to the outer profile of the cam, and accurately reproducing the same, where said cam defines means for maintaining constant volume combustion and has a perimetric profile made up of at least two segments for the optimization of the engine cycle strokes, and where said wheel rotates along the profile of said cam with a minimum friction.

3. A crank system for the transformation of reciprocating linear motion into rotary motion, particularly suitable for reciprocating endothermic engines, comprising: a cam, an output shaft, and a wheel idly provided on an engine piston pin, said wheel being in direct contact with said shaft, said cam having a select profile and being mounted on said shaft where the wheel rolls along a profile concentric with respect to rotation axis of the output shaft, said cam having a perimetric profile made up of at least two segments for the optimization of the engine cycle strokes, said wheel rotating along the profile of said cam with a minimum friction, and means for maintaining the contact between the wheel and the cam, said means for maintaining being comprised of a rod, constrained at one end, with one or more degrees of freedom, to the piston and to the other end constrained to an elastic system absorbing the inertial energy during the stroke from the Bottom Dead Center to the Top Dead Center, giving back the same energy during the first part of the stroke from the Top Dead Center to the Bottom Dead Center.

4. The crank system according to claim 3, characterized in that said cam has a first profile segment having one or more curvatures so as to optimize the induction stroke and the expansion stroke, and a second profile segment having one or more curvatures so as to optimize the compression and exhaust strokes.

5. The crank system according to claim 3, further comprising an additional segment or arch to allow the increase of the function time-cross-section during the exhaust and transfer strokes.

6. The crank system according to claim 3, where said wheel and said cam are made from a material with an elasticity limit sufficient to withstand the compression stress exerted by the wheel.

7. The crank system according to claim 3, further comprising means for maintaining the contact between the wheel and the cam.

8. The crank system according to claim 3, characterized in that the segments are cam arches and said cam provides further arches to optimize constant volume combustion in correspondence with the Top Dead Center (TDC), and the optimization of the expansion stroke, in correspondence with the Bottom Dead Center (BDC).

9. The crank system according to claim 8, characterized in that said further arches have a constant curvature ray corresponding to the distance between the engine axis and the curvature determining the Bottom Dead Center, and respectively the Top Dead Center.

10. The crank system according to claim 3, where said elastic system is replaced with an hydraulic system controlled by microprocessors.

11. The crank system according to claim 3, where it is used in multi-cylinder engines providing at least one cam for all the cylinders.

12. The crank system according to claim 4, characterized in that said cam provides further segments to optimize constant volume combustion, in correspondence of the TDC, and the optimization of the expansion stroke, in correspondence of the BDC.

13. The crank system according to claim 12, characterized in that said further segments are arches which have a constant curvature ray corresponding to the distance between the engine axis and the curvature determining the Bottom Dead Center, and respectively the Top Dead Center.

14. The crank system according to claim 12, characterized in that it provides a further segment to allow the increase of the function time-cross-section during the exhaust and transfer strokes.

15. The crank system according to claim 13, characterized in that it provides a further arch to allow the increase of the function time-cross-section during the exhaust and transfer strokes.

16. The crank system according to claim 15, characterized in that it is used in multi-cylinder engines, providing one cam for each cylinder.

17. The crank system according to claim 15, characterized in that said wheel and said cam are made from a material with an elasticity limit sufficient to withstand the compression stress exerted by the wheel.

18. The crank system according to claim 17, further comprising means for maintaining the contact between the wheel and the cam.

19. The crank system according to claim 17, characterized in that it is used in multi-cylinder engines, providing one cam for each cylinder.

20. The crank system according to claim 18, characterized in that it is used in multi-cylinder engines, providing one cam for each cylinder.

* * * * *